US006460441B1

(12) United States Patent
Harrod

(10) Patent No.: US 6,460,441 B1
(45) Date of Patent: Oct. 8, 2002

(54) ON-DEMAND SKIP PERFORATING

(75) Inventor: Jimmie A. Harrod, Grand Island, NY (US)

(73) Assignee: Moore North America, Inc., Stamford, CT (US)

( * ) Notice: Subject to any disclaimer, the term of this patent is extended or adjusted under 35 U.S.C. 154(b) by 0 days.

(21) Appl. No.: 08/864,858

(22) Filed: May 29, 1997

(51) Int. Cl.[7] ..... B26D 1/62; B26D 5/20; B26F 1/20

(52) U.S. Cl. ..... 83/304; 83/344; 83/346; 83/678

(58) Field of Search ..... 83/304, 305, 343, 83/344, 345, 346, 347, 505, 506, 678, 37, 507, 660

(56) References Cited

U.S. PATENT DOCUMENTS

| | | | | |
|---|---|---|---|---|
| 2,261,315 A | * | 11/1941 | Thorsen | 83/345 X |
| 3,706,250 A | * | 12/1972 | Herd | 83/345 |
| 3,717,057 A | * | 2/1973 | Takimoto | 83/346 X |
| 3,892,156 A | | 7/1975 | Johnstone | 83/469 |
| 3,968,713 A | * | 7/1976 | Mosburger | 83/343 X |
| 4,141,544 A | | 2/1979 | Birkenmayer | 493/355 |
| 4,238,982 A | | 12/1980 | Mock | 83/332 |
| 4,541,337 A | | 9/1985 | Schaul | 101/227 |
| 4,635,316 A | * | 1/1987 | Towne et al. | 83/678 X |
| 5,133,235 A | | 7/1992 | DeVito | 83/347 |
| 5,146,820 A | | 9/1992 | Nemeth et al. | 83/37 |
| 5,265,506 A | * | 11/1993 | Aihara et al. | 83/346 X |
| 5,297,461 A | | 3/1994 | Hirakawa et al. | 83/304 |
| 5,313,863 A | * | 5/1994 | Aihara et al. | 83/346 X |
| 5,359,916 A | | 11/1994 | Bonnet | 83/482 |
| 5,797,305 A | * | 8/1998 | Harrod et al. | 83/346 X |

FOREIGN PATENT DOCUMENTS

| | | |
|---|---|---|
| EP | 040 183 | 11/1981 |
| EP | 138 422 | 4/1985 |
| EP | 208 077 | 1/1987 |
| EP | 723 863 | 7/1996 |
| EP | 739 731 | 10/1996 |
| GB | 2 203 088 | 10/1988 |
| WO | WO 97 23398 | 7/1997 |

* cited by examiner

*Primary Examiner*—Clark F. Dexter
(74) *Attorney, Agent, or Firm*—Nixon & Vanderhye PC

(57) ABSTRACT

An on-demand exact registration form web perforating apparatus is simple yet effective, and can operate at high speed and has a long life. A form web is moved in a predetermined path past first and second rotatable continuous circumferential perforator wheels mounted on substantially stationary axes and spaced from each other along the predetermined path and in alignment with each other along the path. First and second anvil cylinders are spaced from each other along the path for cooperation with the wheels, each cylinder having an interrupted circumference including a raised portion and a depressed portion, and a movable axis about which the cylinder rotates. The cylinders are rotated about the axes synchronously with the web movement, and the cylinders may be selectively moved toward and away from the perforator wheels from a first position in which the entire circumference of each anvil cylinder is spaced from the web and does not cooperate with a perforator wheel, to a second position in which the anvil cylinder circumferential raised portion may engage the web and cooperate with a perforator wheel to effect perforation. Typically the form web comprises a plurality of business forms.

19 Claims, 3 Drawing Sheets

ON-DEMAND SKIP PERFORATING

BACKGROUND AND SUMMARY OF THE INVENTION

The invention relates to a method and apparatus for producing exact length skip perforations in constant and exact registration with a paper web being processed, on-demand from external signals (typically from a computer controller). While there is a significant body of prior art pertaining to what is commonly known in the industry as "quick skip" or "jump" perforating in which perforations are selectively applied to portions of a moving web (typically a web of business forms), there is dearth of prior art that provides exact accuracy of the perforating action in combination with on-demand control.

There are two basic principles of prior art perforating apparatus. The first is either a driven circumferentially sized partial/interrupted anvil, or perforating wheel coacting against either a full circumference perf wheel or anvil cylinder. The second is a cam operated rotary perforating wheel operating against a hardened anvil cylinder. The cam operated device may be easily adapted to on-demand printing, however cam operated devices are normally significantly speed-limited, and are prone to premature wear due to impact forces. Also exact on/off locations for the perforations are extremely difficult to obtain using that system. Therefore according to the present invention a perf wheel/anvil system is utilized which is configured and operated in a novel manner so as to get exact length skip perforations in constant and exact registration with a paper web being processed on-demand from external signals, with long life. The apparatus and method according to the invention are also relatively simple to construct and utilize.

According to one aspect of the present invention an on-demand exact registration form web perforating apparatus is provided comprising the following components: Means for moving a form web in a predetermined path in a first direction. First and second rotatable substantially continuous circumference perforator wheels mounted on substantially stationary axes spaced from each other along the predetermined path, and in alignment with each other along the path in the first direction. First and second anvil cylinders spaced from each other along the predetermined path, each comprising: an interrupted circumference including a raised circumferential portion and a depressed circumferential portion; and a movable axis about which the cylinder rotates. Means for rotating the anvil cylinders about the axes synchronously with the web moving means. And, means for selectively moving each of the axes of the anvil cylinders toward and away from the perforator wheels from a first position in which the entire circumference of the anvil cylinder is spaced from the web and does not cooperate with a the perforator wheel, to a second position in which the anvil cylinder circumference raised portion may engage the web and cooperate with a the perforator wheel to effect perforation of the web substantially parallel to the first direction.

The form web typically comprises a plurality of business forms each having a predetermined length x along the predetermined path, and the perforator wheels each have a circumferential point closest to an anvil cylinder, the circumferential points spaced from each other along the predetermined path a distance yx, where y is a positive whole number (typically 1 or 2). The raised portion of each anvil cylinder and an imaginary continuation thereof over the depressed portion typically has a circumference of 2x.

The selectively moving means may comprise any conventional apparatus for moving the cylinders into operative association with the perf wheels while not interfering with drive of the cylinders. Preferably the selectively moving means move the cylinders toward the perforator wheels so that the centerlines of the anvil cylinders and the centerlines of the perforator wheels are aligned and perpendicular to the web in the second position. In the preferred embodiment of the invention the anvil cylinders are mounted in eccentric bearing housings, and the selectively moving means moves the axes of the anvil cylinders toward and away from the perforator wheels by rotating the eccentric bearing housings so that the eccentric rotation of the bearing housings effects movement between the first and second positions. The means for rotating the eccentric bearing housings may comprise any conventional structure capable of performing that function, such as a linear actuator (such as a high performance air cylinder connected by a crank arm to the housing), or a rotary actuator, stepper motor, or servo motor, the latter two particularly for higher speed operation. Typically the means for rotating the eccentric bearing housings rotates the housings between about 15–25° (preferably about 20°) between the first and second positions and obtain a clearance between the perforator wheel and the raised portion of the interrupted anvil cylinder, when in the first position, of about 0.007 inches.

The means for moving the form web in a predetermined path in a first direction may comprise any conventional web driving mechanism, such as powered drive rollers, take-up shafts or cylinders, or the like. In the preferred embodiment according to the invention the web moving means includes at least first, second and third guide rollers, the anchor cylinders located between the first and third guide rollers in the predetermined path, and a second guide roller located between the second cylinders in the predetermined path. The guide rollers may be positioned with respect to the perforator wheels so that the web is substantially tangent to the perforator wheels when engaging the guide rollers. Since the perforator wheels are not driven, but rather are idler wheels, no perforating action takes place unless the raised portion of the anvil cylinder engages the opposite surface of the web from the perforator wheel. A first plane passes between the centers of the first and third guide rollers that is parallel to a second plane passing between the axes of the perforator wheels, and the first and second planes are spaced a first distance. A third plane passing through the center of the second roller parallel to the first plane is spaced from the second plane a second distance which is less than the first distance, i.e. so that the predetermined path is slightly V-shaped at the perforation area.

The axes of the perforator cylinders are substantially stationary—but can be adjusted to allow minor adjustment of the positions of the perforator wheels with respect to the predetermined path, and thus to provide wheel pressure adjustment.

Another perforator wheel may be mounted on a common axes with each of the first and second wheels, spaced from the first and second wheels in a second direction substantially transverse to the first direction.

According to another aspect of the present invention apparatus for perforating a form web is provided comprising the following components: A predetermined path of movement of a form web. A rotatable substantially continuous circumference perforator wheel mounted on a substantially stationary axis on a first side of said predetermined path. An anvil cylinder comprising: an interrupted circumference including a raised portion and a depressed portion; and a movable axis about which the cylinder rotates, the anvil cylinder mounted in an eccentric bearing housing and the movable axis disposed on a second side of the predetermined path, opposite the first side. Means for rotating the anvil cylinders about the axis. And, means for selectively moving the axis of the anvil cylinder toward and away from the perforator wheel from a first position in which the entire circumference of the anvil cylinder is spaced from the predetermined path and does not cooperate with a the perforator wheel, to a second position in which the anvil cylinder circumference raised portion may intersect the predetermined path and engage a web moving in the path and cooperate with the perforator wheel to effect perforation of the web parallel to the first direction, the selectively moving means comprising means for rotating the eccentric bearing housings so that eccentric rotation of the bearing housings effects movement between the first and second positions.

The details of the means for rotating the eccentric bearing housings, and the like, are preferably as described earlier for the first aspect of the invention.

According to another aspect of the present invention a method of perforating a web of business forms, utilizing first and second substantially continuous circumference perforator wheels operatively spaced from each other along a predetermined web path, and first and second anvil cylinders also operatively spaced from each other along the web path and each having a raised circumferential portion and a depressed circumferential portion, the raised portions for cooperating with the perforator wheels to perforate the web is provided. The method preferably comprises the following steps: (a) Moving the web in a first direction along the predetermined web path. (b) Selectively automatically moving the anvil cylinders from a first position in which no circumferential portion of the anvil cylinders engages the web, to a second position in which the raised circumferential portions of the cylinders may engage the web and cooperate with the perforator wheels to effect perforation of the web parallel to the first direction. (c) Rotating the anvil cylinders so that a point on the circumference thereof moves tangentially in the first direction synchronously with the movement of the web in the first direction. And, (d) selectively automatically moving the anvil cylinders from the second position to the first position thereof.

The wheels and cylinders are typically spaced from each other along the predetermined path a distance yx where x is the length of a form of the web along the predetermined path and y is the positive whole number, and the circumference of each of the raised portions of the anvil cylinder and an imaginary extension thereof overlying the depressed portions is equal to 2x; and then steps (a)–(d) are practiced to perforate each even form in the web with the first wheel and cylinder, and perforate each odd form in the web with the second wheel and cylinder. Steps (b) and (d) are preferably practiced so as to move the centerline of each anvil cylinder and the centerline of its associated perforator wheel into alignment and substantially perpendicular to the web; and in response to electrical signals from a computer control (such as a Moore XL Data System, available from Moore U.S.A., Inc. of Lake Forest, Ill.).

It is the primary object of the present invention to provide effective exact length skip perforations in constant and exact registration with a paper web being processed, on-demand from external signals, and with a long life of the components utilized. This and other objects of the invention will become clear from an inspection of the detailed description of the invention and from the appended claims.

DETAILED DESCRIPTION OF THE DRAWINGS

Figure 1:
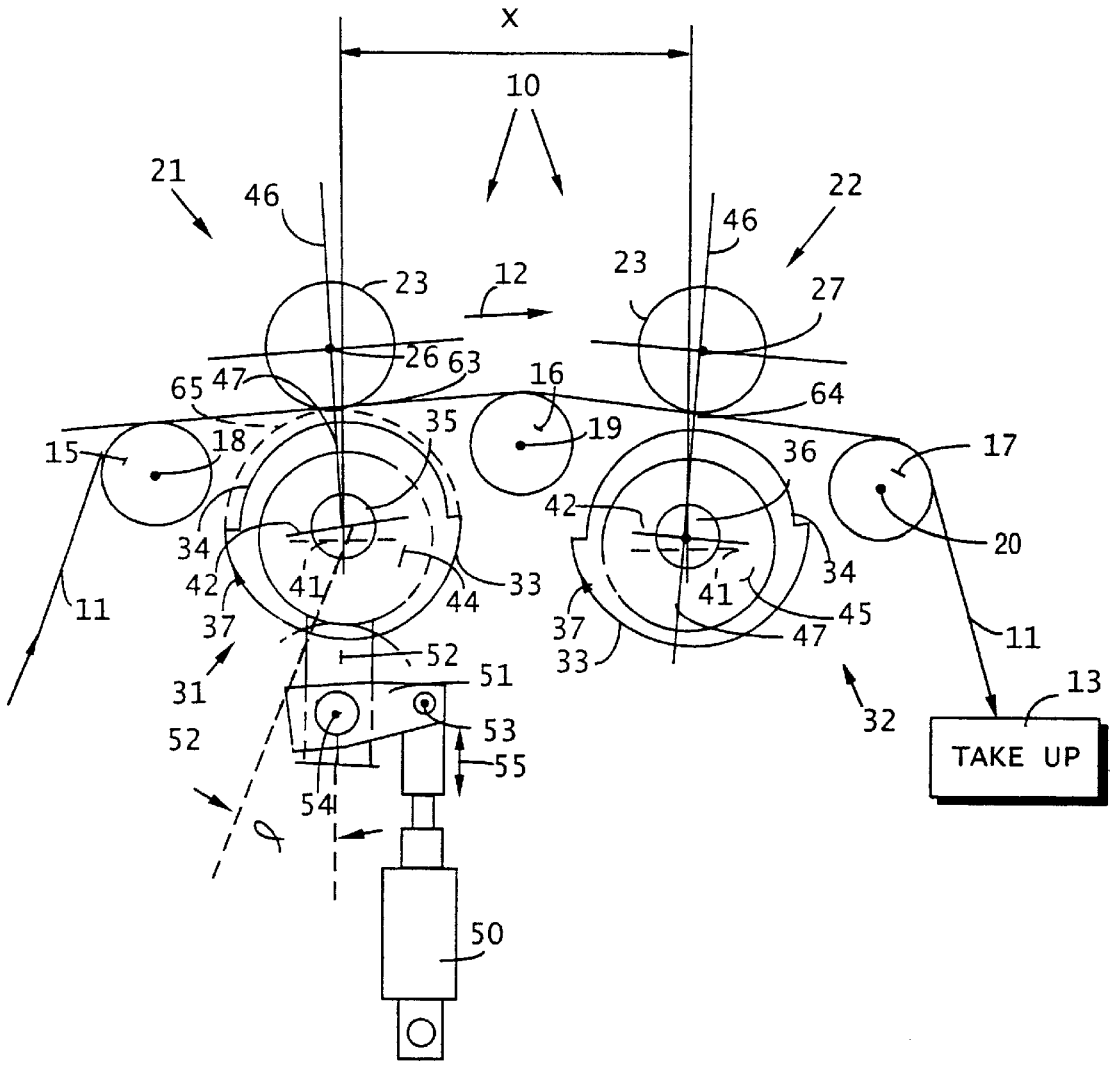
FIG. 1 is a side schematic view of an exemplary on-demand exact registration form web perforating apparatus according to the present invention.

An exemplary embodiment of an on-demand exact registration form web perforating apparatus according to the present invention is shown generally by reference numeral 10 in FIG. 1. The apparatus 10 includes means for moving a paper web of business forms, 11, in a predetermined path (shown by the heavy line for the web 11 in FIG. 1) generally in a first direction 12. The web moving means may comprise any conventional web drive components, such as drive rollers, take-up shafts or cylinders, tractor drive apparatus, or the like. For example FIGS. 1 and 5 schematically illustrate a conventional tractor drive and take-up apparatus 13, powered by an electric motor 14 (see FIG. 5). The web moving means also preferably includes at least first, second, and third guide rollers 15, 16, and 17, respectively (see FIGS. 1 and 4) which are spaced from each other in the direction 12 and have substantially parallel axes of rotation 18 through 20, respectively. The predetermined path of the web 11 between the guide rollers 15, 17 is typically substantially linear, but may have a slight V-shape, as illustrated in FIG. 1. That is if the axes 18 through 20 are substantially horizontal, the axes 18, 20 are at essentially the same height while the axis 19 is slightly higher.

Figure 2:
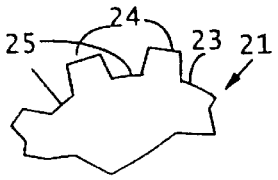
FIG. 2 is a detail enlarged view of a portion of the perforator wheel circumference for a perforator wheel utilized with the apparatus of FIG. 1.

The apparatus 10 further comprises first and second rotatable substantially continuous circumference perforator wheels 21, 22. The circumference 23 of each of the wheels 21, 22 is substantially continuous in that there are no large discontinuities. However because the perforator wheels 21, 22 are conventional perforator wheels, they do have a contoured surface as illustrated by the sharpened peaks 24 and valleys 25 illustrated schematically in FIG. 2. The relative lengths of the peaks 24 and valleys 25, and the number of peaks and valleys provided per inch, may be adjusted depending upon what type of perforations (e.g. standard perforations, microperforations, or the like) are to be provided in the web 11.

The perforator wheels 21, 22 are mounted on substantially stationary axes 26, 27, spaced from each other along the predetermined path that web 11 transverses, and in alignment with each other along the path in the first direction 12, as illustrated in FIG. 1. The wheels 21, 22 are on the opposite side of the path from the guide rollers 15 through 17. In the embodiment illustrated in FIG. 1, a plane passing through the axes 18, 20 is parallel to a plane passing through the axes 26, 27; and a plane passing through the axis 19 parallel to the planes between the axes 18, 20 and 26, 27, respectively, is closer to the plane passing through the axes 26, 27 than is the plane passing through the axes 18, 20.

Figure 3:
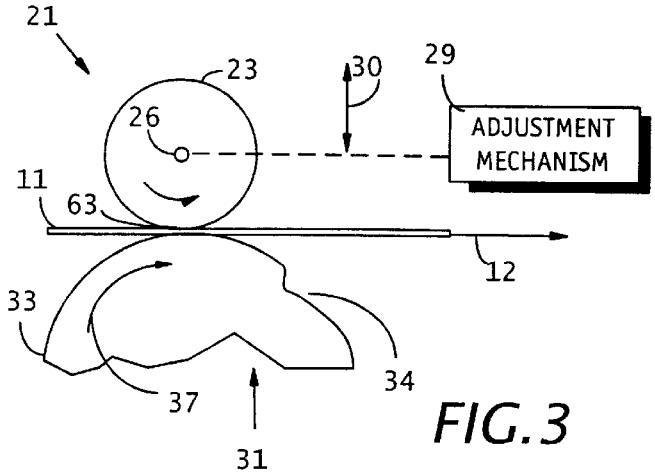
FIG. 3 is a side detail schematic view showing a perforator wheel and anvil cylinder of the apparatus of FIG. 1 cooperating to effect perforation of a web.

The perforator wheels 21, 22 are not driven, but rather are idler wheels. The axes 26, 27 are substantially stationary in that there is no intended predetermined movement thereof, especially during operation of the apparatus 10. However, it is desired that the positions of the axes 26, 27 be adjustable slightly in order to provide wheel pressure adjustment. FIG. 3 schematically illustrates an adjustment mechanism 29 which allows adjustment in the dimension 30 toward and away from the web 11. Also the axial position (that is along the axis 26 or axis 27) of the wheels 21, 22 also may be provided by the adjustment mechanism 29. The adjustment mechanism 29 may be any conventional adjustment mechanism for effecting these purposes, such as a perforating wheel holder manufactured by EMT Corporation of Green Bay, Wis.

The apparatus 10 also comprises first and second anvil cylinders 31, 32 also spaced from each other along the predetermined path of the web 11 and for cooperation with the wheels 21, 22 respectively. Each of the cylinders 31, 32 includes a raised circumferential portion 33, and a depressed circumferential portion 34. The anvil cylinders 31, 32 may include conventional split shell interrupted anvil segments (commonly known as Kidder technology) so that the circumferential extent of the raised portions 33 may be adjusted. In the preferred embodiment illustrated in the drawings, each raised surface 33 is continuous and extends about 180° around the circumference of the cylinder 31, 32, while the depressed portion 34 is also continuous and extends approximately 180°. The anvil cylinders 31, 32 themselves are conventional, and may be of any construction that will properly cooperate with a perforator wheel 21, 22—as illustrated schematically in FIG. 3—to effect perforation of the paper web 11 in a dimension parallel to the first direction 12.

The cylinders 31, 32 rotate about movable axes on shafts 35, 36, respectively (see FIGS. 1 and 5), and are driven about the axes/shafts 35, 36—as indicated by the directional arrows 37 in FIGS. 1, 3, and 5—synchronously with the web 11 movement in direction 12. That is a tangent to the cylinder 31, 32 circumference at the point where perforating takes place (see FIG. 3) is in line with the path of web movement, and generally in the direction 12.

Synchronous powered rotation of the cylinders 31, 32 about the axes/shafts 35, 36 may be accomplished in any suitable conventional manner, such as by using gears—illustrated schematically at 38 and 39 in FIG. 5—powered by the same motor 14 that powers the take-up 13 (or other web moving device). That is the motor 14, take-up 13, and gears 38, 39 may be driven by a synchronous shaft illustrated schematically at 40 in FIG. 5, to make sure that the cylinders 31, 32 and the web 11 move in exact registry.

The apparatus 10 also comprises means for selectively moving each of the axes 35, 36 of the cylinders 31, 32 toward and away from the perforator wheels 21, 22 from a first position—illustrated by the dotted line 41 in FIG. 1—in which the entire circumference of the anvil cylinder 31, 32 is spaced from the web 11 and does not cooperate with the perforator wheel 21, 22, to a second position—illustrated in solid line in FIGS. 1 and 3, including the axes centerline 42 illustrated in FIG. 1—in which the anvil cylinders 31, 32 raised portions 33 engage the web 11 (but portions 34 do not) during rotation, and cooperate with a perforator wheel 21, 22 (as illustrated in FIG. 3) to effect perforation of the web 11 substantially parallel to the first direction 12.

The means for selectively moving the axes 35, 36 may comprise any conventional device that is capable of performing that function. In the preferred embodiment schematically illustrated in the drawings the selectively moving means comprises eccentric bearing housings 44, 45. The preferred geometry of the bearing housings 44, 45 is such that the axial centerlines of the perforator wheels, illustrated at 46 in FIG. 1, at the high point of the bearing housing eccentric (the anvil cylinder centerline) is indicated by lines 42 in FIG. 1, and the centerline 47 of the housing 44, 45 outside diameter {and anvil cylinders 31, 32} are all in-line when in the operating position as illustrated in FIG. 1. That is the selectively moving means move the anvil cylinders 31, 32 toward the perforator wheels 21, 22 so that the centerline 47 of the anvil cylinders 31, 32 and the centerlines 46 of the perforator wheels 21, 22 are aligned, and substantially perpendicular to the web 11 and direction of movement 12, in the second position. This geometry negates any impact from over travel or deflection (related to actuation) thus allowing faster operating speeds and extended perforator wheel 21, 22 life.

The selectively moving means also comprises means for rotating the eccentric bearing housing 44, 45 so that eccentric rotation of the housings 44, 45 effects movement between the first and second positions. The means for rotating the bearing housings may comprise—associated with each of the cylinders 31, 32 (although only one such structure is shown in FIG. 1—associated with the cylinder 31) a linear actuator 50 connected by a crank arm 51 to the housing 44 (e.g. an extension 52 of the housing 44). The crank arm 51 is pivoted at 53 to the linear actuator 50, and at 54 to the bearing housing extension 52. Elongation or retraction in the dimension indicated by arrows 55 in FIG. 1 rotates the housing 44 from the solid line position of the extension 52 thereof illustrated in FIG. 1 to the dotted line position of the extension 52 illustrated in FIG. 1, that angle of rotation being the angle $\alpha$ illustrated in FIG. 1. In the preferred embodiment the angle $\alpha$ is between about 15–25°, preferably about 20°. The linear actuator 50 may be a high performance air cylinder, or any other conventional linear actuator, or another type of actuator could be utilized, such as conventional rotary actuator, a conventional stepper motor, or a conventional servo motor, the latter two for higher speed operation.

The details of the mountings of the eccentric housings 44, 45 and their cooperation with the drives for the shafts/axes 35, 36 may vary widely, and any suitable structures for that purpose may be provided. For example the eccentric housings 44, 45 may be contained in side frames fitted with needle or roller bearings to facilitate rapid on and off operation (where high speed operation is required—that is where the web 11 is moving at high speed, e.g. over 200 ft./min.). The rotary motion for the on and off operation of the eccentric bearing housings is synchronized from side to side through a synchronizing shaft, illustrated schematically at 54 in FIG. 1, and also fitted with anti-friction bearings contained in the side frames. Anti-friction linkages, or gears and pinions, may be employed to transmit the required rotary motion from the synchronizing shaft 54 to the eccentric housings 44, 45.

FIG. 5 schematically illustrates a control for the apparatus 10. The control system preferably includes—as illustrated at 57 in FIG. 5— a conventional Moore XL Data System, available from Moore U.S.A., Inc. of Lake Forest, Ill. The XL Data System 57 provides two separate (momentary) form lag signals, one (n) for even numbered page locations (e.g. the unit 32, 22 in FIG. 1) and one (n+1) for odd numbered page locations (e.g. the unit 21, 31 in FIG. 1). The phase angle of the two individual units would then determine which unit would actuate (that is if the upstream unit 22, 32 were out of phase for perforating an n signal would not actuate the unit, however the downstream unit 21, 31 would be in phase one form later, when the n+1 signal is received, and vice versa). Each individual unit (22, 32 or 21, 31) remains actuated for 180° of rotation.

Figure 4:
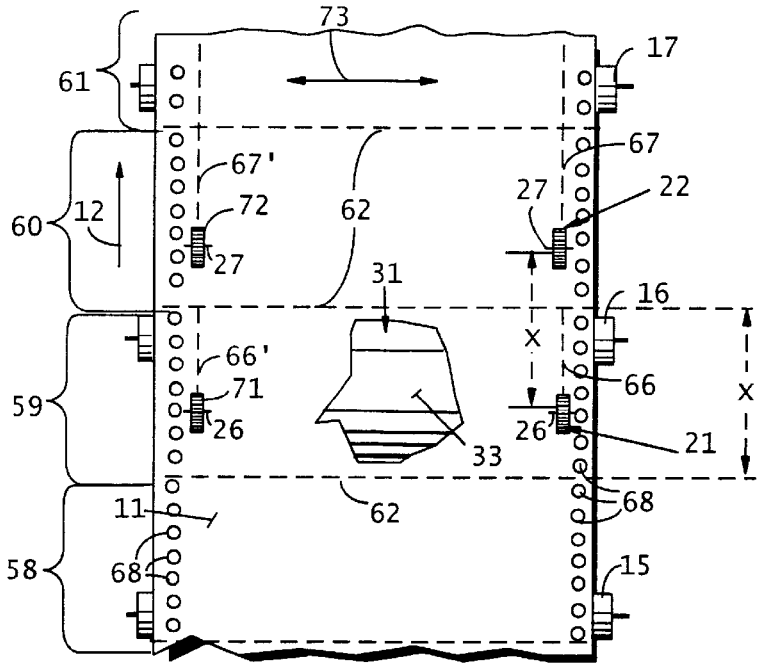
FIG. 4 is a top plan schematic view showing operation of the apparatus of FIG. 1 to effect perforations in a web parallel to the direction of movement of the web.
Figure 5:
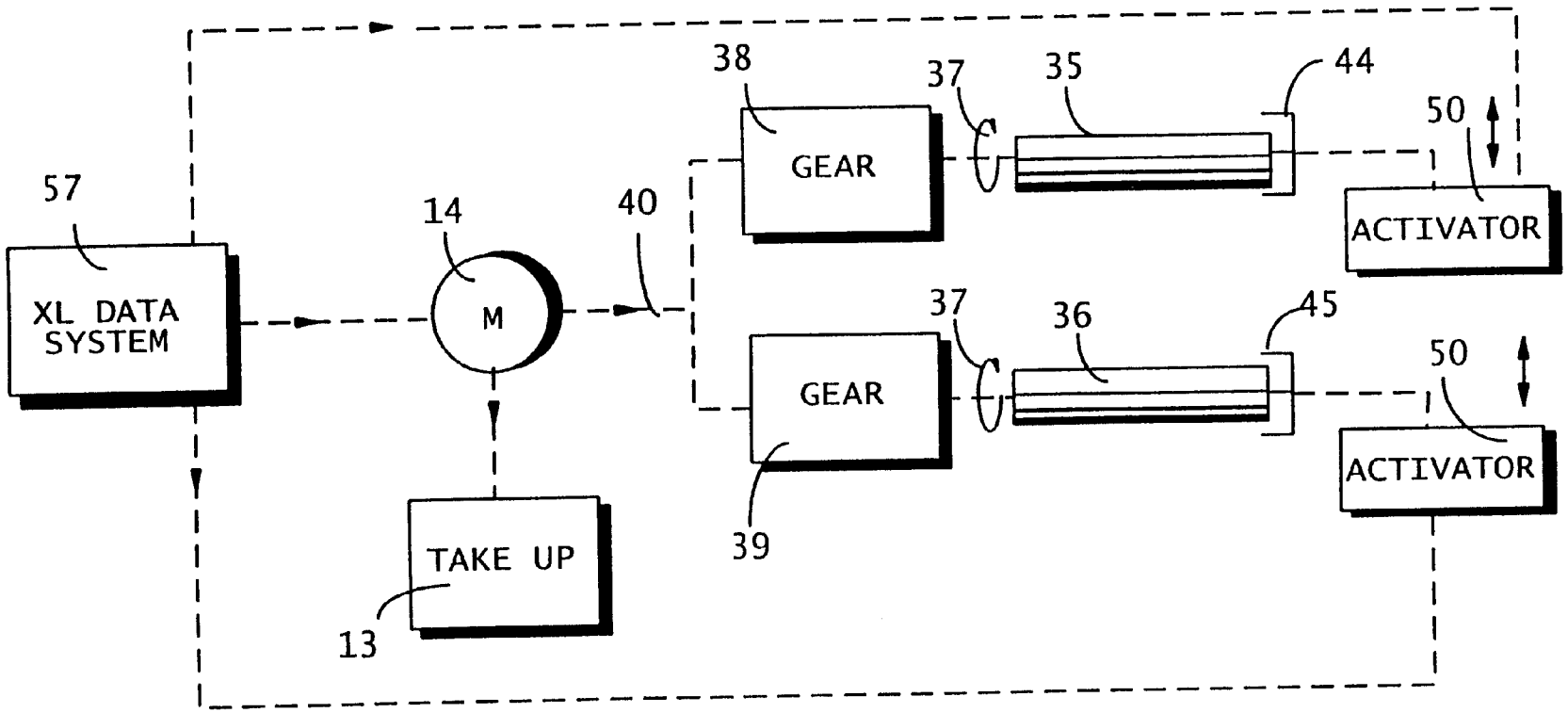
FIG. 5 is a control schematic for the apparatus of FIG. 1.

FIG. 4—in association with FIG. 1—shows the most exemplary operation of the apparatus 10 according to the invention for perforating the web 11. As seen in FIG. 4 the web 11 includes a plurality of business forms, e.g. the consecutive forms 58 through 61 illustrated in FIG. 4, each of the forms being typically separated from each other by a cross line of weakness 62, such as a perforation line. Each of the forms has a predetermined length x along the predetermined path of the web 11. The perforator wheels 21, 22 each have a circumferential point (the exact part of the wheel comprising that point changing as the wheel rotates during the perforating action) as seen at 63 and 64 in FIG. 1 closest to the associated anvil cylinder 31, 32, where the actual perforation takes place. As seen in both FIG. 1 and FIG. 4, the circumferential points 63, 64 are spaced from each other along the predetermined path of the web 11 a distance yx, where y is a positive integer. In the embodiment actually illustrated in FIGS. 1 and 4, y=1, but depending upon the circumstances y may equal 2, 3, or almost any other reasonable positive integer. With this particular construction the raised portion 33 of each of the anvil cylinders 31, 32 and an imaginary continuation (illustrated by dotted line 65 in FIG. 1) over the depressed portion 34, has a circumference of 2x. Thus consecutive forms will be perforated by the different units 21, 31, and 22, 32. This is illustrated in FIG. 4 where as the web 11 is powered in the direction 12 a perforation line 66 is being formed in the web 59 by the wheel 21 and cylinder 31, while the perforation 67 is being formed in the form 60 by the wheel 22 and the cylinder 32.

FIG. 4 also illustrates several other modifications that may be provided according to the invention. For example FIG. 4 illustrates conventional tractor drive openings 68 which cooperate with conventional tractor drive systems such as the take-up 13. FIG. 4 also illustrates another perforated wheel 71, 72 mounted on a common axes 26, 27, respectively with each of the wheels 21, 22, respectively, and spaced from the wheels 21, 22 in a second direction 73 (substantial parallel to the lines of weakness 62) substantially transverse to the first direction 12. In that way the perforation lines 66, 66' and 67, 67', respectively, may be formed at the same time by the wheels 21, 71, and 22, 72, respectively.

Practicing the method of the invention, the web 11 is moved in the direction 12 along the predetermined path illustrated in FIG. 1, and utilizing the XL Data System 57 which controls the actuators 50 the anvil cylinders 31, 32 may—on-demand—be selectively automatically moved between the a position in which no circumferential portion of the anvil cylinders 31, 32 can engage the web 11, to a second position in which the raised circumferential portions 33 of the cylinders 31, 32 may engage the web 11 (as seen in FIG. 3) during rotation, and cooperate with the perforator wheels 21, 22 to drive those wheels and to effect perforation of the web 11 parallel to the first direction 12. The anvil cylinders 31, 32 are rotated by the motor 14 and associated drive components so that a point on the circumference thereof moves tangentially in the first direction 12 synchronously with the movement of the web 11 in the first direction 12, as illustrated in FIG. 3. The method also comprises selectively automatically moving the anvil cylinders 31, 32 from a second position to the first position thereof when on-demand perforation is no longer required, in the first position there typically being a clearance of about 0.007 inches between the web 11 and perforator wheels 21, 22, and the raised portions 33.

The rotating means 50 are preferably independently, although synchronously, controlled by the XL Data System 57, and perforation pressure is not in any way adjusted by the movement of the cylinders 31, 32 by rotation of the eccentric housings 44, 45 so that the axes/shafts are moved between the positions 41, 42 illustrated in FIG. 1. Rather wheel pressure is adjusted solely by the adjustment mechanism 29 for adjusting the position of the wheels 21, 22.

It will thus be seen that according to the present invention an advantageous apparatus and method have been provided for producing exact length skip perforations in constant and exact registration with a paper web being processed, on-demand from external signals. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. An on-demand exact registration form web perforating apparatus, comprising:

means for moving a form web in a predetermined path in a first direction;

first and second rotatable substantially continuous circumference perforator wheels mounted on substantially stationary axes spaced from each other along said predetermined path, and in alignment with each other along said path in said first direction;

first and second anvil cylinders spaced from each other along said predetermined path, each comprising: an interrupted circumference including a raised circumferential portion and a depressed circumferential portion, and a movable axis about which each said cylinder rotates;

means for rotating said anvil cylinders about said axes synchronously with said web moving means; and means for selectively moving each of said axes of said anvil cylinders toward and away from said perforator wheels from a first position in which said entire circumference of said anvil cylinder is spaced from said predetermined path and does not cooperate with a respective one of said perforator wheels, to a second position proximate said predetermined path in which said anvil cylinder circumference raised portion engages said web and cooperates with the respective one perforator wheel to effect perforation of said web substantially parallel to said first direction.

2. Apparatus as recited in claim 1 in combination with a form web, and wherein said form web comprises a plurality of business forms each having a predetermined length x along said predetermined path; and wherein said perforator wheels each have a circumferential point closest to a respective one of said anvil cylinders, said circumferential points spaced from each other along said predetermined path a distance yx, where y is a positive whole number.

3. Apparatus as recited in claim 2 wherein said raised portion of each of said anvil cylinders and an imaginary continuation thereof over said depressed portion has a circumference of 2x.

4. Apparatus as recited in claim 2 wherein said means for moving a form web in a predetermined path in a first direction comprises at least first, second and third guide rollers, said anvil cylinders located between said first and third guide rollers in said predetermined path, and said second guide roller located between said anvil cylinders in said predetermined path.

5. Apparatus as recited in claim 4 wherein said guide rollers are positioned with respect to said perforator wheels so that the predetermined path is substantially tangent to said perforator wheels and said guide rollers.

6. Apparatus as recited in claim 5 wherein a first plane passing between the centers of said first and third guide rollers is parallel to a second plane passing between the axis of said perforator wheels, and the first and second planes are spaced a first distance; and wherein a third plane passing through the center of said second roller parallel to said first plane is spaced from said second plane a second distance less than said first distance.

7. Apparatus as recited in claim 2 further comprising another perforator wheel mounted on a common axis with each of said first and second wheels and spaced from said first and second wheels in a second direction substantially transverse to said first direction.

8. Apparatus as recited in claim 1 in combination with a form web, and wherein said selectively moving means move said cylinders toward said perforator wheels so that the centerlines of said anvil cylinders and the centerlines of said perforator wheels are aligned, and substantially perpendicular to the web, in said second position.

9. Apparatus as recited in claim 8 wherein said anvil cylinder axes are mounted in eccentric bearing housings, and wherein said means for selectively moving each of said axes of said anvil cylinders toward and away from said perforator wheels comprises means for rotating said eccentric bearing housings so that eccentric rotation of said bearing housings effects movement between said first and second positions.

10. Apparatus as recited in claim 9 wherein said means for rotating said eccentric bearing housings comprise linear actuators connected by crank arms to said housings.

11. Apparatus as recited in claim 9 wherein said means for rotating said eccentric bearing housings rotate said housings between about 15–25° between said first and second positions.

12. Apparatus as recited in claim 1 wherein the positions of said axes of said perforator cylinders are adjustable to allow minor adjustment of the positions of said perforator wheels with respect to said predetermined path to provide wheel pressure adjustment.

13. Apparatus as recited in claim 1 wherein said means for moving a form web in a predetermined path in a first direction comprises at least first, second and third guide rollers, said anvil cylinders located between said first and third guide rollers in said predetermined path, and said second guide roller located between said anvil cylinders in said predetermine path.

14. Apparatus as recited in claim 13 wherein said guide rollers are positioned with respect to said perforator wheels so that the predetermined path is substantially tangent to said perforator wheels and said guide rollers.

15. Apparatus as recited in claim 14 wherein a first plane passing between the centers of said first and third guide rollers is parallel to a second plane passing between the axis of said perforator wheels, and the first and second planes are spaced a first distance; and wherein a third plane passing through the center of said second roller parallel to said first plane is spaced from said second plane a second distance less than said first distance.

16. Apparatus for form web perforating, comprising:

a predetermined path of movement of a form web;

first and second rotatable, substantially continuous circumference perforator wheels mounted on a substantially stationary axes spaced from each other along a first side of said predetermined path;

first and second anvil cylinders, each comprising: an interrupted circumference including a raised circumferential portion and a depressed circumferential portion; and a movable axis about which said cylinder rotates, each said anvil cylinder being mounted in an eccentric bearing housing and said movable axis disposed on a second side of said predetermined path, opposite said first side;

means for rotating said anvil cylinders about said axes; and means for selectively moving the axis of each said anvil cylinder toward and away from a respective one said perforator wheels, from a first position in which said entire circumference of said anvil cylinder is spaced from said predetermined path and does not cooperate with said perforator wheel, to a second position in which said anvil cylinder circumference raised portion may intersect said predetermined path and engage the form web moving in said path and cooperate with said respective one of the perforator wheels to effect perforation of said web parallel to said first direction, said selectively moving means comprising means for rotating said eccentric bearing housing so that eccentric rotation of said bearing housing effects said movement between said first and second positions.

17. Apparatus as recited in claim 16 wherein said means for rotating said eccentric bearing housing comprises a linear actuator connected by a crank arm to said housing.

18. Apparatus as recited in claim 16 wherein said means for rotating said eccentric bearing housing rotates said housing between about 15–25° between said first and second positions.

19. Apparatus as recited in claim 16 in combination with a form web, and wherein said selectively moving means moves said cylinder toward said perforator wheel so that the centerline of said anvil cylinder and the centerline of said perforator wheel are aligned and perpendicular to said predetermined path of movement in said second position.

* * * * *